US007088240B2

(12) United States Patent
Inata et al.

(10) Patent No.: US 7,088,240 B2
(45) Date of Patent: Aug. 8, 2006

(54) SURVEILLANCE SYSTEM WITH SURVEILLANCE TERMINALS AND SURVEILLANCE CENTER

(75) Inventors: Keisuke Inata, Yokohama (JP); Taku Nakamura, Yokohama (JP); Masahiro Kageyama, Hino (JP); Hiroyasu Ohtsubo, Yokohama (JP); Takuya Imaide, Fujisawa (JP); Teruki Niki, Tokyo (JP); Masaomi Ueda, Saitama-ken (JP); Hiroaki Yoshio, Tokyo (JP)

(73) Assignees: Hitachi, Ltd., Tokyo (JP); Matsushita Electric Industrial Co., Ltd., Osaka (JP)

( * ) Notice: Subject to any disclaimer, the term of this patent is extended or adjusted under 35 U.S.C. 154(b) by 111 days.

(21) Appl. No.: 10/618,426

(22) Filed: Jul. 10, 2003

(65) Prior Publication Data

US 2004/0113769 A1 Jun. 17, 2004

(30) Foreign Application Priority Data

Dec. 13, 2002 (JP) ..... 2002-361776

(51) Int. Cl.
*G08B 1/08* (2006.01)
*G08B 29/00* (2006.01)

(52) U.S. Cl. ..... 340/539.18; 340/506; 340/531; 340/539.16

(58) Field of Classification Search ..... 340/506, 340/531, 539.16, 539.17, 539.18, 7.29; 725/105, 725/108

See application file for complete search history.

(56) References Cited

U.S. PATENT DOCUMENTS

| | | | | |
|---|---|---|---|---|
| 4,692,742 | A * | 9/1987 | Raizen et al. | 340/539.22 |
| 5,278,539 | A * | 1/1994 | Lauterbach et al. | 340/539.18 |
| 6,028,514 | A * | 2/2000 | Lemelson et al. | 340/539.13 |
| 6,049,272 | A * | 4/2000 | Lee et al. | 340/539.18 |
| 6,745,021 | B1 * | 6/2004 | Stevens | 455/404.1 |

FOREIGN PATENT DOCUMENTS

| | | |
|---|---|---|
| JP | 2000-316146 | 11/2000 |
| JP | 2002-271522 | 9/2002 |

* cited by examiner

*Primary Examiner*—Donnie L. Crosland
(74) *Attorney, Agent, or Firm*—Townsend and Townsend and Crew LLP

(57) ABSTRACT

A surveillance system having surveillance terminals and a surveillance center is configured to perform effective hazard alert signaling, depending on the hazard type. The surveillance system comprises a plurality of surveillance terminals, which are connected to the surveillance center by a network, carries out hazard and alert signaling. One surveillance terminal detects a hazard and sends a hazard information signal reporting what hazard has just been detected to the surveillance center. The surveillance center receives the hazard information signal, identifies what type of hazard source and the surveillance terminal that sent the hazard information signal, selects surveillance terminals to be alerted to the hazard from among the plurality of surveillance terminals, depending on the identified type of the hazard source and its locality, and sends a hazard alert signal to the selected surveillance terminals.

5 Claims, 9 Drawing Sheets

| HAZARD OCCURRING | COORDINATES | DISTANCE FROM HAZARD | AREA TO ALERT ON |
|---|---|---|---|
| a1 | x20y10 | 0 | 0 |

| HOME | COORDINATES | DISTANCE FROM HAZARD | AREA TO ALERT ON |
|---|---|---|---|
| a2 | x10y20 | 10 | 1 |
| a3 | x30y0 | 10 | 1 |
| b1 | x0y0 | 22 | 2 |
| b2 | x−10y−10 | 36 | 3 |
| ⋮ | ⋮ | ⋮ | ⋮ |

FIG. 6

| HAZARD SOURCE \ ALERT SCOPE | AREA 0 (LOCALITY OF HAZARD) | AREA 1 (NARROW SCOPE) | AREA 2 (WIDE SCOPE) |
|---|---|---|---|
| A (WINDOW BREAKAGE) | ○ | — | — |
| B (FIRE) | ○ | ○ | — |
| C (HOUSEBREAKER) | ○ | ○ | ○ |
| ⋮ | ⋮ | ⋮ | ⋮ |

(MARK ○ INDICATES THE AREA TO ALERT ON)

FIG. 7

| HAZARD SOURCE \ ALERT SCOPE | AREA 0 (LOCALITY OF HAZARD) | AREA 1 (NARROW SCOPE) | AREA 2 (WIDE SCOPE) |
|---|---|---|---|
| B & C (ARSON) | ○ | ○ | ○ |
| ⋮ | ⋮ | ⋮ | ⋮ |

(MARK ○ INDICATES THE AREA TO ALERT ON)

FIG. 8

| HAZARD SOURCE \ ALERT SCOPE | AREA 0 (LOCALITY OF HAZARD) | AREA 1 (NARROW SCOPE) | AREA 2 (WIDE SCOPE) |
|---|---|---|---|
| A & B (ARSON) | ○ | ○ | ◎ |
| ⋮ | ⋮ | ⋮ | ⋮ |

(MARK ○ INDICATES THE AREA TO ALERT ON)
(DOUBLE CIRCLE MARK INDICATES WEIGHT)

FIG. 9

| HAZARD SOURCE \ SURVEILLANCE MODE | AREA 0 | AREA 1 | AREA 2 | AREA 3 |
|---|---|---|---|---|
| A (WINDOW BREAKAGE) | MODE 1 | — | — | — |
| B (FIRE) | MODE 3 | MODE 2 | — | — |
| C (HOUSEBREAKER) | MODE 2 | MODE 1 | MODE 1 | — |
| ⋮ | ⋮ | ⋮ | ⋮ | ⋮ |

FIG. 10

| HAZARD SOURCE \ SURVEILLANCE MODE | AREA 0 | AREA 1 | AREA 2 | AREA 3 |
|---|---|---|---|---|
| A & C (ARSON) | MODE 2 | MODE 1 | MODE 1 | — |
| ⋮ | ⋮ | ⋮ | ⋮ | ⋮ |

FIG. 11

| HAZARD SOURCE \ SURVEILLANCE MODE | AREA 0 | AREA 1 | AREA 2 | AREA 3 |
|---|---|---|---|---|
| A & C (ARSON) | MODE 3 | MODE 2 | MODE 1 | — |
| ⋮ | ⋮ | ⋮ | ⋮ | ⋮ |

FIG. 12

| HAZARD SOURCE \ SURVEILLANCE MODE | AREA 0 | AREA 1 | AREA 2 | AREA 3 |
|---|---|---|---|---|
| A ≧ 10 (10 OR MORE TIMES OF WINDOW BREAKAGE ACCIDENTS) | MODE 2 | MODE 1 | MODE 1 | — |

SURVEILLANCE SYSTEM WITH SURVEILLANCE TERMINALS AND SURVEILLANCE CENTER

BACKGROUND OF THE INVENTION

1. Field of the Invention

The present invention relates to a surveillance system, surveillance terminals, and a surveillance center, the surveillance system being configured to detect a hazard such as crime, calamities, etc. and alert residents to the hazard in the locality of the hazard and its vicinity, and the invention relates to a hazard and alert signaling method.

2. Description of the Related Art

In a prior art surveillance system built by networking a surveillance center and a plurality of surveillance terminals, the surveillance center performs the surveillance control, using discrete links to each surveillance terminal. For example, when a surveillance terminal detects a hazard, the surveillance center obtains information in various aspects of the hazard from only the surveillance terminal that has just detected the hazard and performs the surveillance and alert task, based on the obtained information (for example, refer to Kokai, Japanese Unexamined Patent Publication No. 2000-316146).

In another similar system of prior art, when a hazard occurs in one of a plurality of homes existing in one area, the home security communications device provided in that home outputs a hazard detection signal and this signal is sent over a wireless channel via a communication managing unit in the area to the surveillance center. The surveillance center signals a hazard alert to mobile phones carried by residents of the above home and also signals the alert to the hazard occurred in the one home to other homes within the same area (for example, refer to Kokai, Japanese Unexamined Patent Publication No. 2002-271522).

BRIEF SUMMARY OF THE INVENTION

For the latter one of the foregoing systems of prior art, when a hazard occurs in a home in an area, the residents of other homes in the same area are alerted to the hazard, and, therefore, it is possible to prevent the damage from the hazard from spreading. However, alert signaling to the residents in other areas is not taken into consideration. Consequently, it is impossible to control alerting the residents of homes in other areas so that the alerting will be performed, if necessary, depending on the hazard type.

Upon the reception of a hazard signal from a home in an area, the surveillance center is able to send a hazard alert signal to homes in other areas. For the residents of the homes in other areas, alerting them to all hazards of any type, when it occurs outside the area where they live, may be rather annoying because they would receive many alert messages that are unnecessary for them. Meanwhile, it is a burden for the surveillance center to send alert signals upon the occurrence of any hazard to the homes in other areas as well as the hazard locality area because a huge amount of data must be collected in the surveillance system.

It is an object of the present invention to provide a surveillance system, surveillance terminals, and a surveillance center, the surveillance system being configured to perform effective hazard alert signaling, depending on the hazard type, and a hazard and alert signaling method.

In order to achieve the foregoing object, a surveillance system of the present invention comprises a plurality of surveillance terminals and a surveillance center, the plurality of surveillance terminals being connected to the surveillance center by a network carries out hazard and alert signaling. One of the surveillance terminals detects a hazard and sends a hazard information signal reporting what hazard has just been detected to the surveillance center. The surveillance center receives the hazard information signal, identifies what type of the hazard source and the surveillance terminal that sent the hazard information signal, selects surveillance terminals to be alerted to the hazard from among the plurality of surveillance terminals, depending on the identified type of the hazard source and its locality, and sends a hazard alert signal to the selected surveillance terminals.

In some implementation of the invention, it may be preferable that the surveillance center selects areas to be alerted to the hazard from among a plurality of areas studded with the plurality of surveillance terminals, depending on the identified type of the hazard source and its locality, and sends a hazard alert signal to the surveillance terminals that fall in the selected areas.

In some implementation of the invention, it may be preferable that the surveillance center sends commands of different-level surveillance modes in which the hazard information signal is sent in different levels of information depth to the plurality of surveillance terminals, one of the commands of the different-level surveillance modes to be sent to each surveillance terminal being selected, depending on the identified type of the hazard source and its locality.

A surveillance terminal of the present invention is connectable to the surveillance center via a network and comprises equipment which is able to detect a plurality of hazards and a communications unit which sends a hazard information signal reporting what hazard has just been detected as one of the plurality of hazards to the surveillance center.

The surveillance center of the invention to which a plurality of surveillance terminals can be connected via a network comprises a communications unit which receives a hazard information signal sent from a surveillance terminal when a hazard occurs and sends a hazard alert signal to terminals, an identifier which identifies what type of the hazard source and the surveillance terminal that sent the hazard information signal, and a selector which selects surveillance terminals to be alerted to the hazard from among the plurality of surveillance terminals.

The invention also provides a hazard and alert signaling method for use in a surveillance system where a plurality of surveillance terminals are connected to a surveillance center by a network. The hazard and alert signaling method comprises a first process to be performed at one of the surveillance terminals and a second process to be performed at the surveillance center. The first process comprises the steps of detecting a hazard and sending a hazard information signal reporting what hazard has just been detected to the surveillance center. The second process comprises the steps of receiving the hazard information signal, identifying what type of the hazard source and the surveillance terminal that sent the hazard information signal, selecting surveillance terminals to be alerted to the hazard from among the plurality of surveillance terminals, depending on the identified type of the hazard source and its locality, and sending a hazard alert signal to the selected surveillance terminals.

In some implementation of the hazard and alert signaling method, it may be preferable to select areas to be alerted to the hazard from a plurality of areas studded with the plurality of surveillance terminals, depending on the identified type of the hazard source and its locality, and send a hazard alert signal to the surveillance terminals that fall in the selected areas.

In some implementation of the hazard and alert signaling method, it may be preferable to send commands of different-level surveillance modes in which the hazard information signal is sent in different levels of information depth to the plurality of surveillance terminals, wherein one of the commands of the different-level surveillance modes to be sent to each surveillance terminal is selected, depending on the identified type of the hazard source and its locality.

BRIEF DESCRIPTION OF THE SEVERAL VIEWS OF THE DRAWINGS

These and other objects, features and advantages of the present invention will become more readily apparent from the following detailed description when taken in conjunction with the accompanying drawing wherein:

FIG. 4 is a diagram for explaining the areas to alert on.

FIG. 5 shows a data table example, a part of a hazard source by area database in FIG. 1, by which the areas to alert on are determined upon the occurrence of a hazard.

FIG. 6 shows a data table example, a part of the hazard source by area database in FIG. 1, in which the alert scope changes, depending on the hazard source type.

FIG. 7 shows another data table example in which the alert scope for a hazard source is set.

FIG. 8 shows yet another data table example in which the alert scope for a hazard source is set.

FIG. 9 shows a data table example in which surveillance modes are set, depending on the hazard source type.

FIG. 10 shows another data table example in which surveillance modes are set in the case of a specific hazard.

FIG. 11 shows yet another data table example in which surveillance modes are set in the case of a specific hazard.

FIG. 12 shows a further data table example in which surveillance modes are set in the case of a specific hazard.

DETAILED DESCRIPTION OF THE INVENTION

Figure 1:
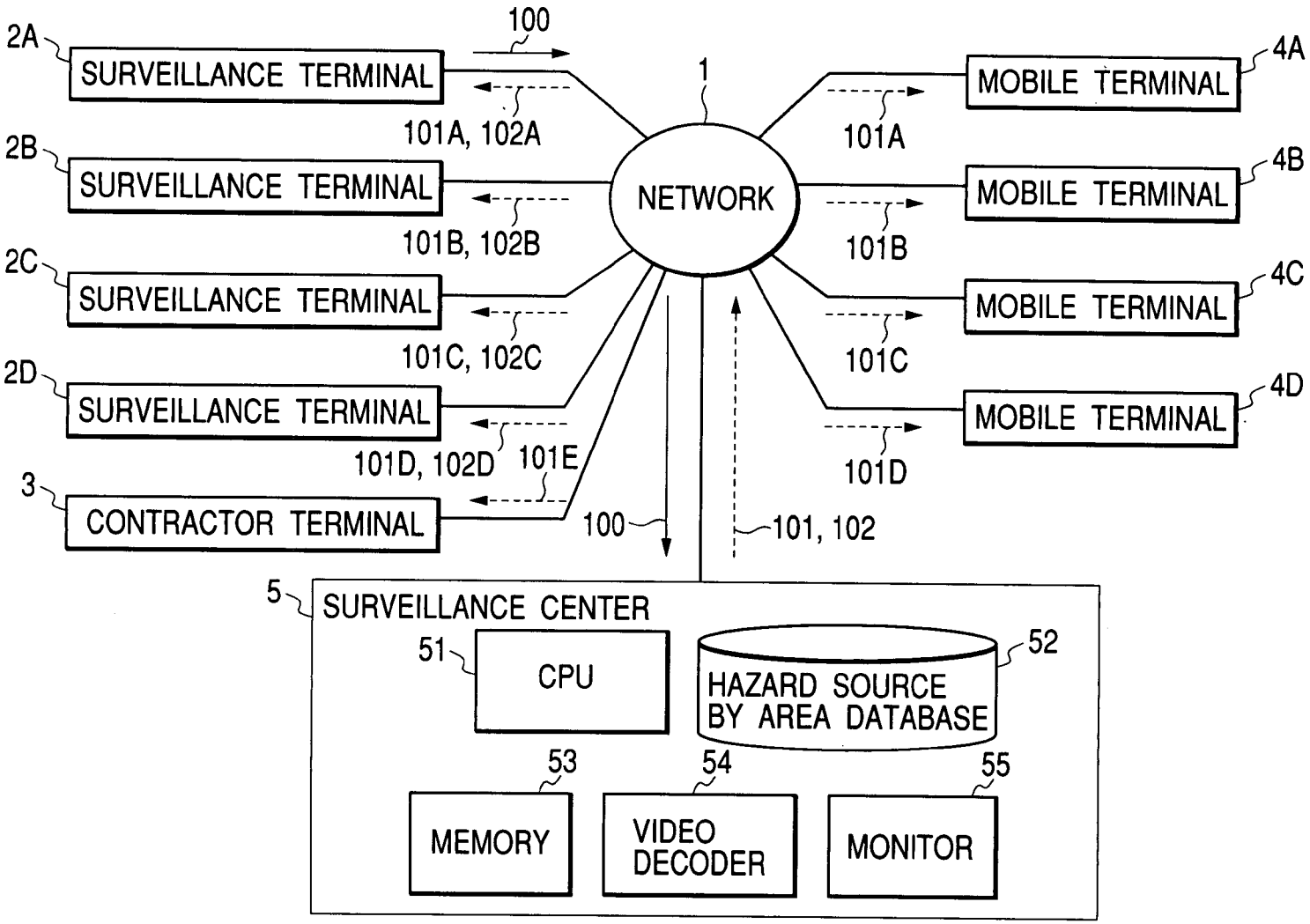
FIG. 1 is a diagram showing a surveillance system configuration in accordance with a preferred embodiment of the present invention.

FIG. 1 is a diagram showing a surveillance system configuration in accordance with a preferred embodiment of the present invention. The surveillance system of the present embodiment is build by networking of surveillance terminals 2A, 2B, 2C, 2D, a contractor terminal 3, mobile terminals 4A, 4B, 4C, 4D, and a surveillance center 5, wherein the surveillance terminals existing in the areas around a spot where a hazard has just occurred are deployed in cooperative surveillance.

Figure 2:
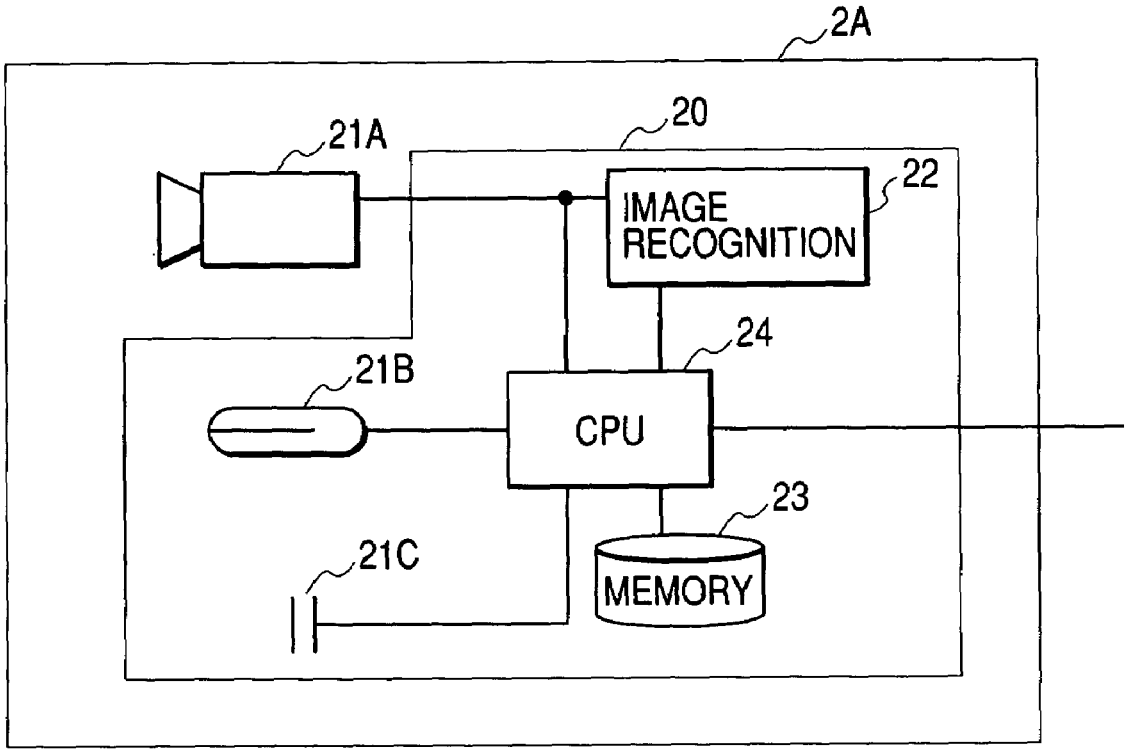
FIG. 2 is a diagram showing the configuration of a surveillance terminal in FIG. 1.

FIG. 2 is a diagram showing the configuration of the surveillance terminal 2A. The typical configuration of the surveillance terminal 2A will be described and other surveillance terminals 2B, 2C, 2D are assumed configured in the same as will be described. The surveillance terminal 2A is primarily comprised of a surveillance camera 21A and a control unit 20. The control unit 20 is comprised of a thermal sensor 21B, an impact sensor 21C, an image recognition unit 22, a memory 23, and a CPU 24. The image recognition unit 22 receives video data of a view captured by the surveillance camera 21A, compares successive video data frame by frame, and detects a hazard by a significant change in the view. By using the surveillance camera 21A, an invader such as a housebreaker can be detected. The thermal sensor 21B detects a hazard when temperature exceeds a predetermined temperature. By using the thermal sensor 21B, a fire can be detected. The impact sensor 21C detects a hazard by a strong impact on a thing to which it is installed. By attaching the impact sensor 21C to a window, the window breakage can be detected.

When the image recognition unit 22, terminal sensor 21B, or impact sensor 21C detects a hazard, the CPU 24 outputs a hazard information signal 100 packet comprising a hazard ID signal which indicates what hazard has been detected and a surveillance terminal specific ID number. This packet is sent to the surveillance center 5 over the network 1. Upon the occurrence of a hazard, the CPU 24 stores the video data relevant to the hazard, captured by the surveillance camera 21A, into the memory 23. When the surveillance center 5 inquires for the video data, the CPU 24 reads the video data from the memory 23 and sends it to the surveillance center 5 over the network 1. The video data to be sent may be encoded video signals which have been encoded and compressed by the CPU 24. Or video signals of the captured view may be sent in real time. Capability of each surveillance terminal includes receiving a hazard alert signal from the surveillance enter and alarming its user to the hazard.

In FIG. 1, the surveillance center 5 is comprised of a CPU 51, a hazard source by area database 52, a memory 53, a video decoder 54, and a monitor 55.

The CPU 51 receives the above-mentioned hazard information signal 100 sent from each surveillance terminal 2A, 2B, 2C, compares the hazard information with the corresponding one in the hazard source by area database 52, and determines what the hazard type is. The hazard information signal 100 includes a terminal ID assigned to each terminal and, therefore, the CPU 51 can identify the surveillance terminal that sent the hazard information signal 100.

The hazard source by area database 52 associates a pattern of the above hazard information signal 100 with a hazard type. The video signal sent from each surveillance terminal may be stored into the memory 53 or can be output to the monitor 55. An encoded video signal can be decoded by the video decoder 54.

After determining what the hazard type is, the CPU 51 determines a surveillance mode and areas or terminals to alert on, according to the hazard type and issues a surveillance command, 102A, 102B, 102C, or 102D, which specifies the appropriate surveillance mode, or sends a hazard alert signal, 101A, 101B, 101C, or 101D. Also, the hazard alert signal may be sent to the appropriate ones of the mobile terminals 4A, 4B, 4C, 4D, each being related to each surveillance terminal.

Here, surveillance modes are surveillance control modes, one of which a surveillance terminal should apply. By way of illustration, surveillance modes in which a surveillance terminal sends video data of a view captured by its surveillance camera to the surveillance center 5 will be described. Surveillance modes 1, 2, and 3 are defined as follows. Surveillance mode 1 is a mode in which the surveillance terminal sends only the information that a hazard just occurred to the surveillance center 5. Surveillance mode 2 is a mode in which the surveillance terminal sends sparsified video data of the view captured by the surveillance camera at a low rate, for example, two frames per second. Surveillance mode 3 is a mode in which the surveillance terminal sends non-sparsified video data of the view captured by the surveillance camera at a high rate, for example, 30 frames per second. Comparing these surveillance modes 1, 2, and 3 in terms of data quantity to be sent to the surveillance center 5, the greatest quantity of data is sent in surveillance mode 3, the smallest quantity of data is sent in surveillance mode 1, and surveillance mode 2 is medium. Bit rates of encoding video data may be used to distinguish the surveillance modes.

When a surveillance terminal, one of 2A, 2B, 2C, 2D, receives a surveillance command, one of 102A, 102B, 103C, 104D, from the surveillance center 5, the surveillance terminal performs surveillance control, according to the command-specified surveillance mode. For example, if a surveillance terminal is commanded from the surveillance center 5 to apply the above surveillance mode 2, the surveillance terminal enters the mode in which it sends video data to the surveillance center 5 at a rate of two frames per second.

The above-mentioned areas to alert on mean the areas where the terminals existing therein are to receive a hazard alert signal 101A, 101B, 101C, or 101D. Upon the occurrence of a hazard, the surveillance center sends a hazard alert signal to at least any surveillance terminals or the users thereof, or any mobile terminals existing in the areas to alert on; that is, either the appropriate ones of the surveillance terminals 2A, 2B, 2C, 2D or the appropriate ones of the mobile terminals 4A, 4B, 4C, 4D, each used by one who has each surveillance terminal or relates to the one who has it.

An extended alert scope can be set to alert not only the mobile terminal users existing in the area where the hazard has just occurred, but also other mobile terminal users out of the area. For example, assuming that a mobile terminal used by one of the family who has a surveillance terminal is mobile terminal A and a mobile terminal used by a pre-registered relative or friend of the above family is mobile terminal B, it is possible to configure the system such that the surveillance center determines whether to alert only the mobile terminal A or both the mobile terminals A and B, depending on the type of a hazard occurring. It is also possible to configure the system such that the surveillance center alerts the mobile terminal B if there is no response to the alert signal to the mobile terminal A.

It is also possible to configure the system such that the surveillance center not only sends a hazard alert signal to the appropriate surveillance terminal users or related mobile terminals, but also sends another alert signal 101E to the contractor terminal 3 under a contract with the surveillance center 5. Alternatively, it is also possible to configure the system such that the surveillance terminal sends a hazard alert signal to any mobile terminal via the network 1.

Figure 3:
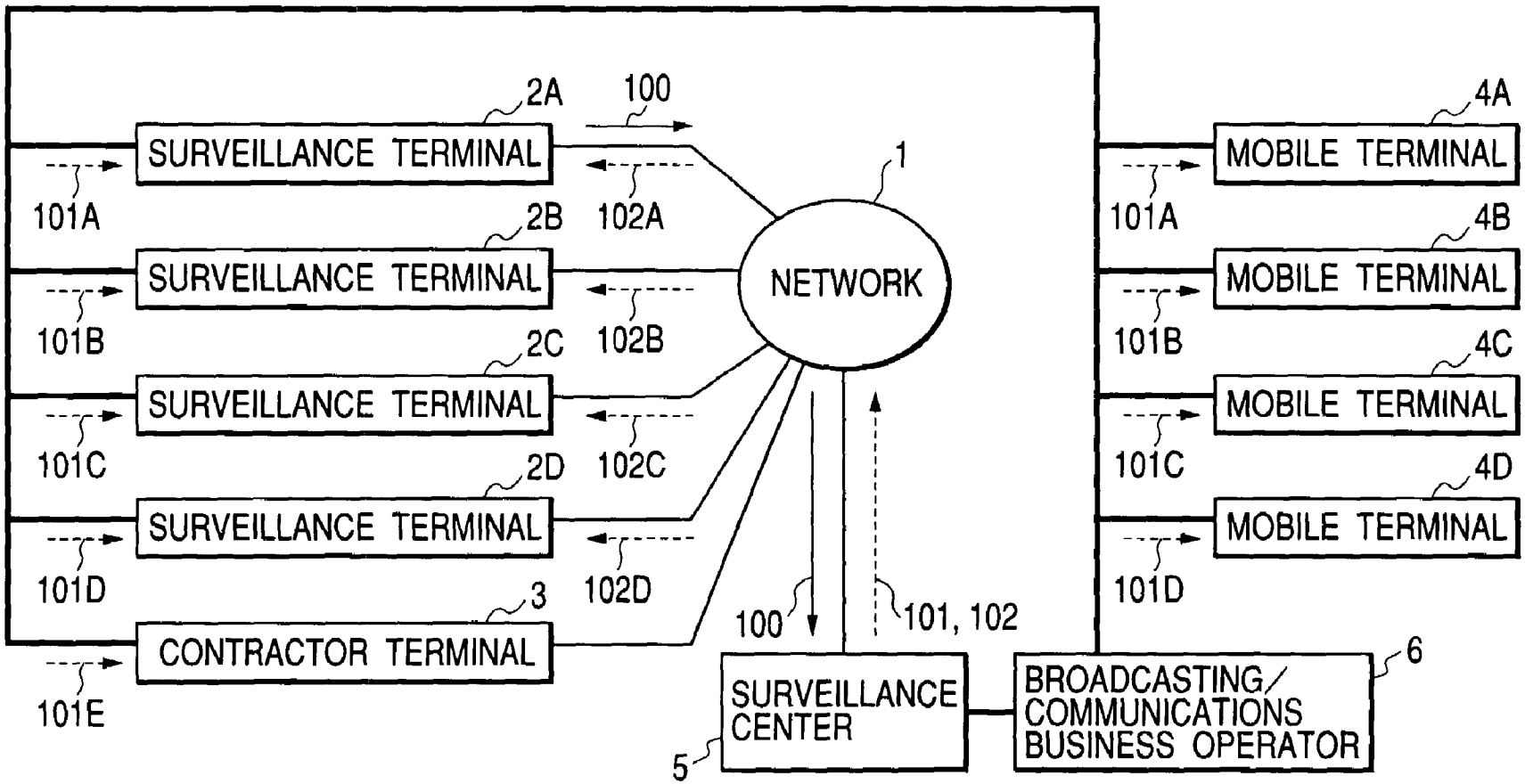
FIG. 3 is a diagram showing a surveillance system configuration in accordance with another preferred embodiment of the present invention.

FIG. 3 is a diagram showing a surveillance system configuration in accordance with another preferred embodiment of the present invention. The surveillance system of this embodiment is alternation to the corresponding system of FIG. 1, using a different way of hazard alert signaling from the way applied in the system of FIG. 1.

In the surveillance system of FIG. 1, when a hazard occurs, the surveillance center 5 receives the hazard information signal 100 and sends a hazard alert signal to appropriate surveillance terminals or mobile terminals or the contractor terminal selected, according to the data in the hazard source by area database 52. In the surveillance system of FIG. 3, on the other hand, a broadcasting/communications business operator 6 which made a contract with the surveillance center 5, instead of the surveillance center 5, sends a hazard alert signal.

Examples of the broadcasting/communications business operator 6 are a cable broadcasting company, network provider company, BS/CS broadcasting company, data broadcasting company, mobile telephone company, etc. The hazard alert signal is sent to appropriate surveillance terminals or mobile terminals or the contractor terminal through leased or general-purpose channels or communications lines possessed or used by the broadcasting/communications business operator 6.

Determining terminals to which the hazard alert signal is to be sent is made by the surveillance center or the broadcasting/communications business operator, based on the contract made with the surveillance center.

Figures 4, 5:
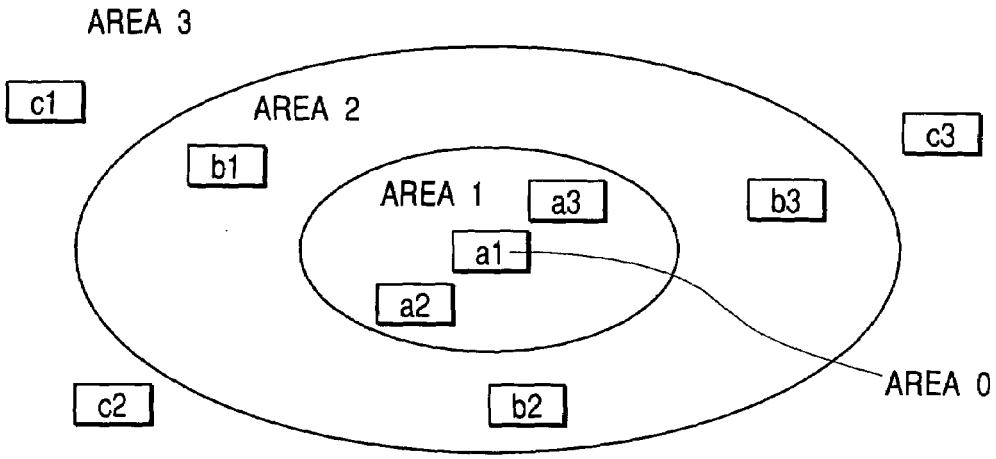

FIG. 4 is a diagram for explaining the areas to alert on. On the assumption that surveillance terminal a1 has just detected a hazard, areas 0 to 3 to alert on are defined as shown in this diagram. The locality of the hazard occurred is area 0 and, around the area 0, an inner area 1, a medium-range area 2, and an outer area 3 are marked off, according to the distance from the area 0. Area 1 is studded with surveillance terminals a2 and a3, besides a1. Area 2 is studded with surveillance terminals b1, b2, and b3. Area 3 is studded with surveillance terminals c1, c2, and c3. According to the type of hazard source, the extent of each area and the areas to fall within the alert scope can be changed.

FIG. 5 shows a data table example, a part of the hazard source by area database 52 in FIG. 1, by which the areas to alert on are determined upon the occurrence of a hazard. On the surveillance center 5 in FIG. 1, the hazard source by area database 52 includes the geographic coordinates of each home (where each surveillance terminal is installed), which have been obtained in advance. When a hazard occurs in a home a1, the distance of every other home from the hazard is calculated. According to the distance, areas 1, 2, and 3 to alert on are set. The extent of each area may be changed, depending on the hazard type.

If, for example, area 0 and area 1 are determined as the areas to alert on, the hazard alert signal is sent to the surveillance terminals and mobile terminals existing in the areas 0 and 1 and the mobile terminals respectively used by the ones who each have the surveillance terminals in the areas.

By sending the hazard alert signal to the terminals and the mobile terminals carried by the families concerned and the like who are being out in both the locality of the hazard (area 0) and its vicinity (area 1), the families concerned and neighbors can become aware of the hazard early and the damage from the hazard can be prevented from spreading.

FIG. 6 shows a data table example, a part of the hazard source by area database 52 in FIG. 1, in which the alert scope changes, depending on the hazard source type. Here, a circle mark (O) indicates the area to alert on.

In one case where hazard A that is, specifically, window breakage has just occurred; only area 0, the locality of hazard is alerted. Area 1, area 2, and area 3 are not alerted. Hazard A is generally regarded as an accident that is dangerous only for the locality of the hazard, but does not affect its surrounding areas.

In another case where hazard B that is, specifically, a fire has just occurred; a narrow scope including the locality of the hazard, namely, area 0 and area 1 are alerted. Hazard B is generally regarded as an accident that is dangerous for both the locality of the hazard and the neighboring area only, but does not affect a wide surrounding zone.

In yet another case where hazard C that is, specifically, a housebreaker has just occurred; a wide zone around the locality of the hazard, namely, area 0, area 1, and area 2 are alerted widely. Hazard C is generally characterized in that there is a high probability that the source of the hazard moves in a wide zone around the locality of the hazard or the damage from the hazard spreads.

FIG. 7 shows another data table example in which the alert scope for a hazard source is set. This example specifies how the areas to alert on are set if a plurality of hazards, for example, hazard B and hazard C have occurred at the same time. In this case, the alert scope is set to include all the areas to alert which are determined for each type of hazard source. According to the table of FIG. 6, area 0 and area 1 are alerted when hazard B only has occurred. Area 0, area 1, and area 2 are alerted when hazard C only has occurred. Therefore, when hazard B and hazard C have occurred at the same time, the wide scope covering all relevant areas, namely, area 0, area 1 and area 2 are alerted.

FIG. 8 shows yet another data table example in which the alert scope for a hazard source is set. This example specifies how the areas to alert on are set if a plurality of hazards, for example, hazard A and hazard B have occurred at the same time. In this case, the alert scope is set in a manner that a relationship between the two hazard sources is taken into account. According to the table of FIG. 6, area 0 is alerted when hazard A occurs and area 0 and area 1 are alerted when hazard B occurs. When hazard A and hazard B with their sources having relation to each other occur at the same time, a new area to alert on should be set, according to the relationship between both. Or a weight corresponding to the relationship should be added to the alert scope set as shown in FIG. 7, thereby finally setting the alert scope for the combination of hazard A and hazard B. That is, weighted area 2 is added to the alert scope setting of area 0 and area 1, as shown in FIG. 7, and, finally, area 0, area 1, and area 2 are set as the alert scope for the combination of hazard A and hazard B.

FIGS. 9, 10, 11, and 12 show data table examples, a part of the hazard source by area database 52 in FIG. 1, in which surveillance modes are set, depending on the hazard source type, and the surveillance commands to specify the modes as specified in the tables are sent to the surveillance terminals. In these figures, three surveillance modes, as described above, are assigned per area. Among surveillance modes 1, 2, and 3, the hazard information signal from a surveillance terminal conveys the most data in mode 3 and the least data in mode 1. The more data to convey, the higher will be the surveillance accuracy, whereas the heavier will be the network load and control load for surveillance.

FIG. 9 shows a data table example in which surveillance modes are set, depending on the hazard source type.

In one case where hazard A that is, specifically, window breakage has just occurred; surveillance is focused on only area 0, the locality of the hazard. Surveillance mode 1 in which surveillance is performed with the least network load and control load is applied (the surveillance terminal in that area outputs a hazard information signal that simply specifies what type of a hazard occurring). Hazard A is generally regarded as an accident that is dangerous only for the locality of the hazard, but does not affect its surrounding areas.

In another case where hazard B that is, specifically, a fire has just occurred; cooperative surveillance is focused on a narrow scope including the locality of the hazard, namely, area 0 and area 1. Of these areas, for area 0 that is the hazard locality, surveillance mode 3 in which surveillance is performed with the highest network load and control load and with high accuracy is executed (the surveillance terminal in that area outputs a hazard information signal conveying non-sparsified video data of the view captured by the surveillance camera). For area 1 that is an inner surrounding area, surveillance mode 2 in which surveillance is performed with less network load and control load is applied (the surveillance terminal in that area outputs a hazard information signal conveying sparsified video data of the view captured by the surveillance camera). Hazard B is generally regarded as an accident which is dangerous for both the locality of the hazard and the neighboring area only, but does not affect a wide surrounding zone.

In yet another case where hazard C that is, specifically, a housebreaker has just occurred; cooperative surveillance is performed for a wide zone around the locality of the hazard, namely, area 0, area 1, and area 2. Of these areas, for area 0 that is he hazard locality, surveillance mode 3 in which surveillance is performed with the highest network load and control load and with high accuracy is executed. For area 1 and area 2 that are surrounding areas, surveillance mode 1 in which surveillance is performed with the least network load and control load is applied. Hazard C is generally characterized in that there is a high probability that the source of the hazard moves in a wide zone around the locality of the hazard or the damage from the hazard spreads.

FIG. 10 shows another data table example in which surveillance modes are set in the case of a specific hazard. This example specifies how the surveillance modes are set if a plurality of hazards, for example, hazard A and hazard C have occurred at the same time. Of the surveillance modes determined for each hazard source, the highest accuracy one of the surveillance modes set per area is finally set.

According to FIG. 9, when hazard A solely occurs, surveillance mode 1 is set for area 0 and ordinary surveillance (without a specific mode) is set for other areas. When hazard C solely occurs, surveillance mode 2 is set for area 0, surveillance mode 1 is set for area 1 and area 2, and ordinary surveillance (without a specific mode) is set for area 3. In the case of FIG. 10, because the highest accuracy one of the surveillance modes set per area is finally set, surveillance mode 2 is set for area 0, surveillance mode 1 is set for area 1 and area 2, and ordinary surveillance is set for area 3.

FIG. 11 shows yet another data table example in which surveillance modes are set in the case of a specific hazard. This example specifies how the surveillance modes are set if a plurality of hazards, for example, hazard A and hazard C have occurred at the same time. In the case of FIG. 11, when two hazards with their sources having relation to each other occur at the same time, the relationship between the two hazards is taken into account and a higher accuracy surveillance mode is finally set per area for the combination of the hazards.

According to FIG. 9, when hazard A solely occurs, surveillance mode 1 is set for area 0 and ordinary surveillance (without a specific mode) is set for other areas. When hazard C solely occurs, surveillance mode 2 is set for area 0, surveillance mode 1 is set for area 1 and area 2, and ordinary surveillance (without a specific mode) is set for area 3. In the case of FIG. 11, it is judged that hazard A and hazard C relate and a higher accuracy surveillance mode is finally set per area; that is, surveillance mode 3 is set for area 0, surveillance mode 2 is set for area 1, surveillance mode 1 is set for area 2, and ordinary surveillance is set for area 3.

FIG. 12 shows a further data table example in which surveillance modes are set in the case of a specific hazard. This example specifies how surveillance modes are set per area if hazard A has occurred a number of times. If hazard A has occurred only once, surveillance mode 1 is executed for area 0 only. If hazard A has occurred a number of times (for example, ten or more times), it is judged that a higher hazard has occurred, and surveillance mode 2 is executed for area 0, thereby increasing the accuracy of surveillance.

The number of times window breakage has occurred, as exemplified in FIG. 12, is detected by the impact sensor 21C (shown in FIG. 2) bonded to a window and the detected number is counted by the CPU 24. A plurality of impact sensors may be bounded to a plurality of windows.

Figure 13:
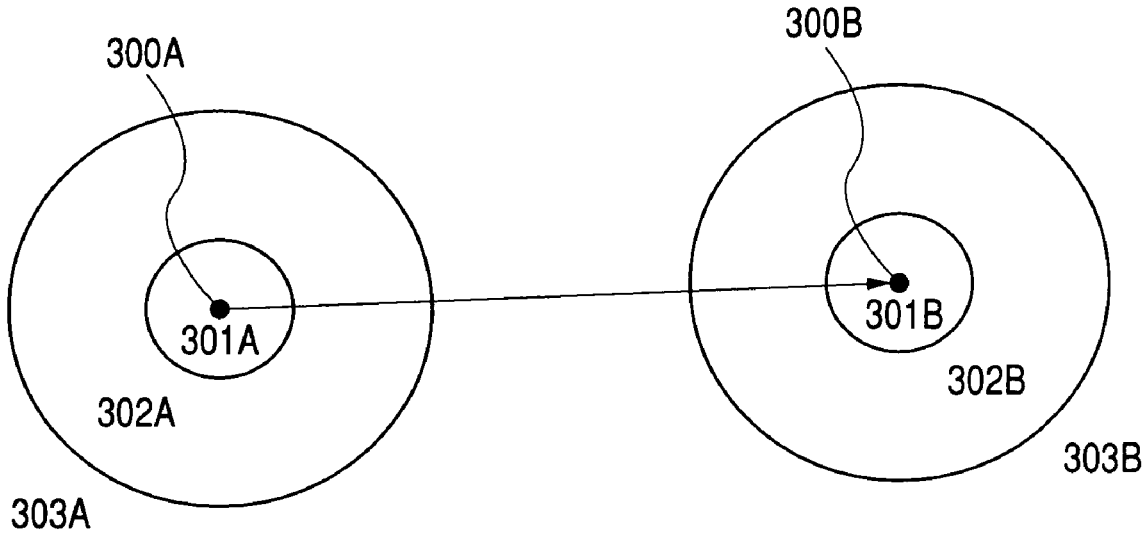
FIG. 13 is a diagram for explaining how the areas to alert on or the areas for which different-level surveillance modes are assigned change as the hazard moves from its initial locality.

FIG. 13 is a diagram for explaining how the areas to alert on or the areas for which different-level surveillance modes are assigned change as the hazard moves from its initial locality. Assuming that the hazard has moved from point 300A to point 300B, this diagram specifies the changed areas to alert on or the changed areas for which different surveillance modes are assigned. The areas to alert on or the areas for which different-level surveillance modes are assigned will be simply referred to as areas hereinafter. Examples of hazard sources characterized in that the hazard moves from its initial locality are sneak thieves, housebreakers, natural calamities, etc.

In the example of FIG. 13, three areas are defined. According to the distance from point 300A from which the hazard has moved, an inner area 301A, a medium-range area 302A, and an outer area 303A are marked off. Correspondingly, according to the distance from point 300B to which the hazard has moved, an inner area 301B, a medium-range area 302B, and an outer area 303B are marked off.

As shown in FIG. 13, when the hazard moves from point 300A to point 300B, the areas to alert on change from 301A to 301B, from 302A to 302B, and from 303A to 303B, so that people who are or may be involved in the hazard can quickly be alerted to the hazard. At the same time, the hazard alert signaling to people who have become having little or no involvement in the hazard is stopped and, consequently, the network load or the control load can be reduced.

As shown in FIG. 13, by changing the areas for which different-level surveillance modes are assigned as the hazard moves, higher accuracy surveillance for the areas that have become involved in the hazard can be performed in real time. At the same time, surveillance for the areas that have become having little or no involvement in the hazard is performed with a lower accuracy level or stopped and, consequently, the network load or the control load can be reduced.

If the hazard locality range from its center point extends, it is possible to extend the areas 301, 302, and 302, accordingly. An example of hazard locality extension is a fire.

Figure 14:
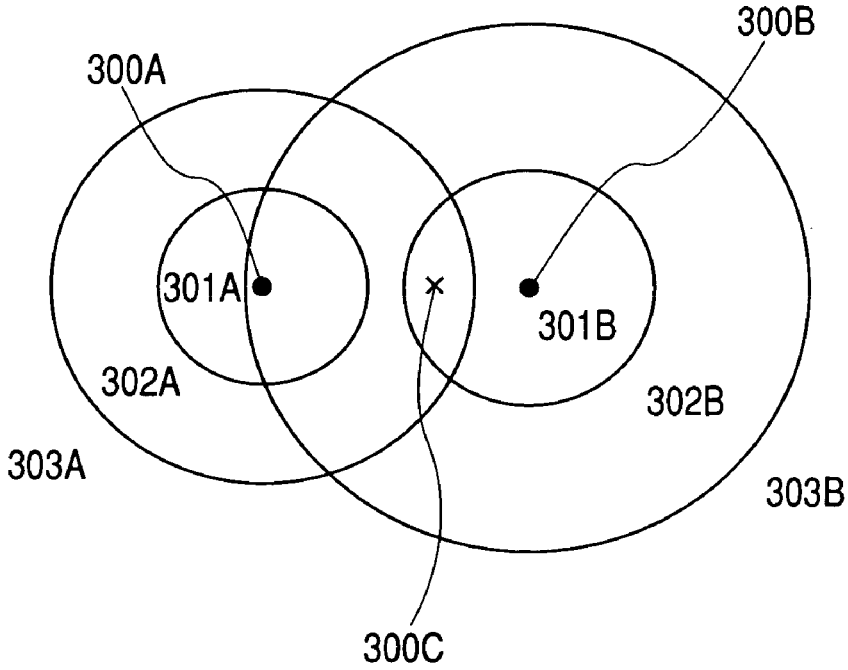
FIG. 14 is a diagram for explaining how the areas for which different-level surveillance modes are assigned are set if hazards occur at a plurality of points at the same time.

FIG. 14 is a diagram for explaining how the areas for which different-level surveillance modes are assigned are set if hazards occur at a plurality of points at the same time. In the example of FIG. 14, three areas are defined. According to the distance from point 300A of one hazard, an inner area 301A, a medium-range area 302A, and an outer area 303A are marked off. Correspondingly, according to the distance from point 300B of another hazard, an inner area 301B, a medium-range area 302B, and an outer area 303B are marked off.

When hazards occur at a plurality of points as shown in FIG. 14, the areas for which different-level surveillance modes are assigned are determined separately per hazard source. Now, consider which surveillance mode is applied at point 300C between point 300A of one hazard and point 300B of another hazard. With regard to one hazard at point 300A, surveillance mode 3 is set for the locality 300A, mode 2 is set for area 301A, mode 1 is set for area 302A, and ordinary surveillance is set for 303A. With regard to another hazard at point 300B, correspondingly, surveillance mode 3 is set for the locality 300B, mode 2 is set for area 301B, mode 1 is set for area 302B, and ordinary surveillance is set for 303B.

At this time, point 300C falls in the surveillance mode 1 area of one hazard that occurs at point 300A and the surveillance mode 2 area of another hazard that occurs at point 300B. At point 300C, finally set is the highest accuracy one of the surveillance modes separately set by the two hazards, one occurring at point 300A, the other occurring at point 300B. In the example case, surveillance mode 2 is finally set for the mode applied at point 300C.

When the above hazards occur, it is also possible to determine a surveillance mode by adding a weight corresponding to a relationship between the hazard sources.

Figure 15:
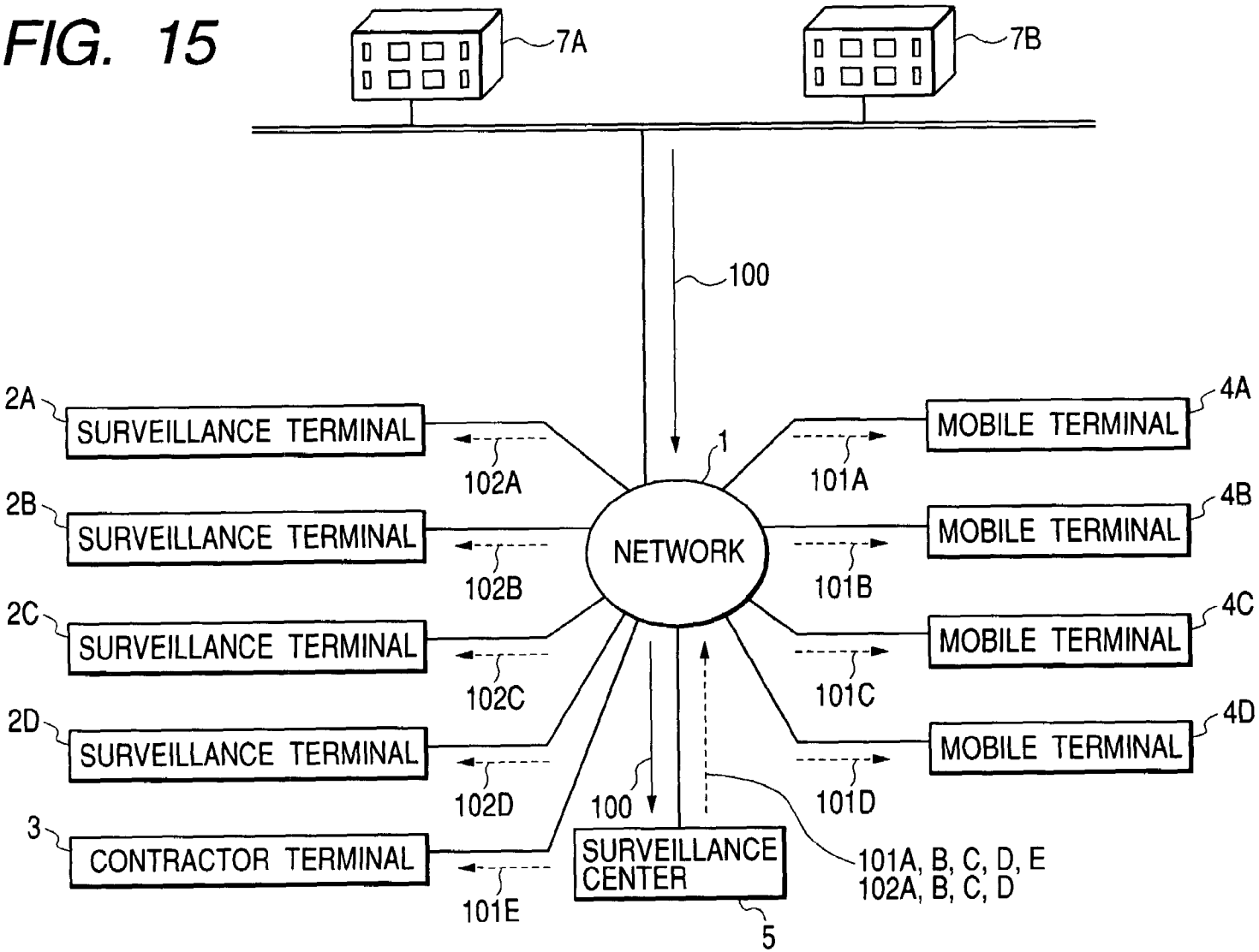
FIG. 15 is a diagram showing a surveillance system configuration in accordance with a further preferred embodiment of the present invention.

FIG. 15 is a diagram showing a surveillance system configuration in accordance with a further preferred embodiment of the present invention. This surveillance system is characterized in that external agencies provide hazard information signals 100 which should be output from the surveillance terminals in the foregoing surveillance system embodiments shown in FIG. 1 or FIG. 3 to report a hazard occurring to the surveillance center. Examples of the external agencies and hazard information are crime warning from the police 7A and fire warning from a firehouse 7B; moreover, robber warning from a bank and natural calamity warning from the Meteorological Agency.

The surveillance system embodiment of FIG. 15 is configured to alert the residents to a hazard by making effective use of external means for hazard detection, in addition to alerting based on the information from the surveillance terminals. By using the system of this embodiment, the accuracy of detecting a hazard that affects all the areas covered by the system in addition to a hazard that may occur in a home can be increased and the surveillance setup across the areas can be enhanced.

According to the embodiments described hereinbefore, a surveillance system where surveillance terminals are networked to a surveillance center and a hazard and alert signaling method can be created with the following advantages. When a hazard occurs, the surveillance terminals to which the hazard alert signal should be sent, the areas where the surveillance terminals to alert on exist, and the different-level surveillance modes to be performed by the surveillance terminals in different areas are changed, depending on the hazard type. Accordingly, the hazard alert signal can be sent effectively to the surveillance terminals and areas that must be alerted to the hazard, depending on the hazard type. In consequence, the users of the surveillance terminals or the residents in the areas where the surveillance terminals are installed would receive little or no alert messages that are unnecessary for them. Meanwhile, the surveillance center sends the commands of surveillance modes suitable for the surveillance terminals and areas to alert on to the surveillance terminals and thereby can perform the per-area surveillance setup in accordance with the hazard occurring and efficient information collection from the surveillance terminals. Moreover, by changing the areas to be alerted to the hazard as the hazard moves from its initial locality, and, if hazards occur at a plurality of points at the same time, by adjusting the surveillance mode to be performed at a point that falls in the overlapped areas around the plurality of points of the hazards, more exact surveillance can be performed.

According to the present invention, a surveillance system, surveillance terminals, and a surveillance center, the surveillance system being configured to perform effective hazard alert signaling, depending on the hazard type, and a hazard and alert signaling method can be provided.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing descriptions. All changes which come within the meaning and range of equivalency of the claims are to be embraced within the scope of the claims.

What is claimed is:

1. A surveillance system comprising a plurality of surveillance terminals and a surveillance center, the plurality of surveillance terminals being connected to the surveillance center by a network, wherein one of said surveillance terminals detects a hazard and sends a hazard information signal reporting what hazard has just been detected to said surveillance center, and said surveillance center receives said hazard information signal, identifies a type of hazard source and the surveillance terminal that sent the hazard information signal, and selects one surveillance mode that depends on the identified type of hazard source and its locality, and wherein said selected surveillance mode is to be sent to each surveillance terminal, and said selected surveillance mode is selected from among surveillance modes whereby a surveillance terminal sends video data of a view captured by its surveillance camera to the surveillance center, and said surveillance center sends a command indicating the one surveillance mode selected to the each surveillance terminal.

2. A surveillance system according to claim 1, wherein, when two or more of said plurality of surveillance terminals respectively detect hazards and send respective hazard information signals to said surveillance center, said surveillance center receive said respective hazard information signals, identifies the type of hazard source and the surveillance terminal that sent the hazard information signal for each of the plurality of hazards, and, depending on the identified type of hazard source and its locality, sets the surveillance mode of each of said plurality of surveillance terminals to a highest accuracy, and one of the surveillance modes separately assigned to an area in which the surveillance terminal is located, depending on each identified type of hazard source.

3. A surveillance system comprising a plurality of surveillance terminals and a surveillance center, the plurality of surveillance terminals located in a plurality of areas being connected to the surveillance center by a network, wherein one of said surveillance terminals detects a hazard and sends a hazard information signal reporting what hazard has just been detected to said surveillance center, and said surveillance center receives said hazard information signal, identifies a type of hazard source and the surveillance terminal that sent the hazard information signal, selects areas to be alerted to the hazard from among a plurality of areas where said plurality of surveillance terminals are located, depending on the identified type of hazard source and its locality, sends a hazard alert signal to the surveillance terminals that are located in the selected areas, selects one surveillance mode that depends on the identified type of the hazard source and its locality, and wherein said selected surveillance mode is to be sent to each surveillance terminal, and said selected surveillance mode is selected from among surveillance modes whereby a surveillance terminal sends video data of a view captured by its surveillance camera to the surveillance center, and said surveillance center sends a command indicating the one surveillance mode selected to the each surveillance terminal according to the area in which the surveillance terminal falls is located.

4. A surveillance system according to claim 3, wherein, when two or more of said plurality of surveillance terminals respectively detect a plurality of hazards and send respective hazard information signals to said surveillance center, said surveillance center sets the surveillance mode for each of said areas to be alerted to a highest accuracy, and one of said surveillance modes separately assigned to to each of said areas, depending on each identified type of hazard source.

5. A hazard and alert signaling method for use in a surveillance system where a plurality of surveillance terminals are connected to a surveillance center by a network, said hazard and alert signaling method comprising a first process to be performed at one of said surveillance terminals and a second process to be performed at said surveillance center, said first process comprising the steps of:

detecting a hazard; and sending a hazard information signal to said surveillance center, said second process comprising the steps of:

receiving said hazard information signal;

identifying a type of hazard source and the surveillance terminal that sent the hazard information signal;

selecting one surveillance mode that depends on the identified type of hazard source and its locality, and wherein said selected surveillance mode is to be sent to each surveillance terminal, and said selected surveillance mode is selected from among surveillance modes whereby a surveillance terminal sends video data of a view captured by its surveillance camera to the surveillance center; and sending a command from said surveillance center indicating the one surveillance mode selected to the each surveillance terminal.

* * * * *